US007735248B2

(12) United States Patent
Sakada et al.

(10) Patent No.: US 7,735,248 B2
(45) Date of Patent: Jun. 15, 2010

(54) PIPING STRUTURE OF FRONT WORK MACHINE

(75) Inventors: Seiji Sakada, Chikugo (JP); Nagahiro Ogata, Chikugo (JP)

(73) Assignee: Yanmar Co., Ltd., Osaka-shi, Osaka (JP)

( * ) Notice: Subject to any disclaimer, the term of this patent is extended or adjusted under 35 U.S.C. 154(b) by 271 days.

(21) Appl. No.: 11/908,703

(22) PCT Filed: Jan. 20, 2006

(86) PCT No.: PCT/JP2006/300799

§ 371 (c)(1),
(2), (4) Date: Sep. 14, 2007

(87) PCT Pub. No.: WO2006/098082

PCT Pub. Date: Sep. 21, 2006

(65) Prior Publication Data

US 2009/0238634 A1 Sep. 24, 2009

(30) Foreign Application Priority Data

Mar. 14, 2005 (JP) ..... 2005-072044

(51) Int. Cl.
*E02F 1/00* (2006.01)
*E02F 9/00* (2006.01)

(52) U.S. Cl. ..... 37/466; 414/694

(58) Field of Classification Search ..... 37/468, 37/466; 172/272–275; 414/680, 686, 723, 414/694, 722, 918; 60/458
See application file for complete search history.

(56) References Cited

U.S. PATENT DOCUMENTS

| | | | | |
|---|---|---|---|---|
| 5,542,339 | A | 8/1996 | Kaczmarczyk et al. | |
| 5,806,313 | A * | 9/1998 | Koshi et al. | 60/458 |
| 6,425,730 | B1 * | 7/2002 | Kaczmarski | 414/723 |
| 7,070,383 | B2 * | 7/2006 | Sugimoto | 414/694 |

FOREIGN PATENT DOCUMENTS

| | | |
|---|---|---|
| FR | 2 846 016 | 4/2004 |
| JP | 60-190839 | 12/1985 |
| JP | 3-103351 | 10/1991 |
| JP | 5-64233 | 8/1993 |
| JP | 11-200409 | 7/1999 |

(Continued)

OTHER PUBLICATIONS

Supplementary European Search Report for European Application No. EP 06 71 2024, European Patent Office, mailed Jan. 20, 2009, 3 pgs.

(Continued)

*Primary Examiner*—Robert E Pezzuto
(74) *Attorney, Agent, or Firm*—Sterne, Kessler, Goldstein & Fox P.L.L.C.

(57) ABSTRACT

There is provided a piping structure of a front work machine which prevents an increase in total with of the front work machine caused by hydraulic piping extended from the main machine side, and enables the piping following a structure of the front work machine turning vertically, by which a burden on the hydraulic piping accompanying the turning of the front work machine can be reduced to improve the durability.

7 Claims, 9 Drawing Sheets

FOREIGN PATENT DOCUMENTS

| | | | |
|---|---|---|---|
| JP | 2000 027234 | A | 1/2000 |
| JP | 2000-314149 | | 11/2000 |
| JP | 2002-308157 | | 11/2001 |
| JP | 2002 013158 | | 1/2002 |

OTHER PUBLICATIONS

International Search Report for International Application No. PCT/JP2006/300799, Japanese Patent Office, mailed Mar. 14, 2006, 3 pgs.

* cited by examiner

PIPING STRUTURE OF FRONT WORK MACHINE

TECHNICAL FIELD

The present invention relates to a hydraulic piping structure of a front work machine such as a loading device (loader) mounted on a main machine in a work vehicle such as a back hoe loader and a tractor.

BACKGROUND ART

Conventionally, in a work vehicle such as a tractor and a back hoe loader, a front work machine such as a loader is mounted on a front portion of a main machine (vehicle) thereof. Some of these front work machines are constituted such that a base portion(s) (rear end portions) is supported by one side or both right and left sides of a bonnet provided in the front portion of the main machine. That is, the constitution is such that on each of the right and left sides or one side of the bonnet, a turnably-supporting part made of a bracket or the like is provided in a body frame or the like on the main machine, and that the base portion of the front work machine is supported by this turnably-supporting part. This allows the front work machine to be supported so as to turn vertically with respect to the main machine (e.g., refer to Patent Document 1).

In the front work machines as described above, some are constituted so as to have a bucket constituted openably and closably by a hydraulic cylinder, a hydraulically-driven auger or the like as a work part, and to require hydraulic oil for operation. In such a constitution, hydraulic piping is extended from the main machine side, and the hydraulic oil is supplied through this hydraulic piping.

In this manner, when the hydraulic oil is supplied to the work part and the like of the front work machine by the hydraulic piping extended from the main machine side, the following problems arise due to the constitution of the front work machine.

As described before, in the case where the front work machine is constituted so as to be supported on the side(s) of the bonnet, the arrangement of the hydraulic piping between the bonnet and the front work machine requires sufficient space between the bonnet and the front work machine. Providing such space for piping causes an increase in total width of the front work machine, and thus, causes an increase in total width of the work vehicle including the main machine.

Moreover, since the front work machine turns vertically with respect to the main machine as described before, the hydraulic piping needs to follow the movement of the front work machine by this turning. That is, the front work machine is a moving side, while the main machine is a non-moving side, and thus, a necessary length of the hydraulic piping connecting the front work machine and the main machine may vary, and also, it can be considered that the turning of the front work machine puts a burden on the hydraulic piping, thereby decreasing its durability, which makes it necessary that the hydraulic piping follows the front work machine.

Consequently, there has been desired a piping structure of the front work machine which prevents an increase in total width of the front work machine due to the hydraulic piping extended from the main machine side, and enables the piping following the structure of the front work machine turning vertically, by which the burden on the hydraulic piping accompanying the turning of the front work machine can be decreased to increase the durability.

[Patent Document 1] Japanese Patent Application Laid-Open No. 2002-308157

DISCLOSURE OF THE INVENTION

Object

As described above, in the constitution of the conventional front work machine, space for hydraulic piping is required between the bonnet and the front work machine, which makes it difficult to prevent the increase in total width of the front work machine. Moreover, in the front work machine supported turnably with respect to the main machine side, in order to address the variation in necessary length of the hydraulic piping caused by the turning of the front work machine, and to prevent the burden on the hydraulic piping, the hydraulic piping needs to be made to follow the movement of the front work machine.

Consequently, an object of the present invention is to provide a piping structure of a front work machine which prevents an increase in total width of the front work machine due to hydraulic piping extended from the main machine side, and enables the piping following a structure of the front work machine turning vertically, by which a burden on the hydraulic piping accompanying the turning of the front work machine can be decreased to increase the durability.

Solution

According to a piping structure of a front work machine of the present invention, in a piping structure of a front work machine mounted on a main machine through turnably-supporting parts on both right and left sides of a bonnet provided in a front portion of the main machine, or a turnably-supporting part on one side thereof, a hole part through which hydraulic piping passes is provided in each of constructional members, or a constructional member of the front work machine.

Moreover, according to the piping structure of the front work machine of the present invention, the front work machine comprises a bucket provided in a front end portion thereof, a lift arm movably supported by the turnably-supporting part, a lift cylinder movably supported by the turnably-supporting part, and arranged on vertical one side of the lift arm to move up and down the lift arm with respect to the turnably-supporting part, and a bucket cylinder movably supported by the turnably-supporting part, and arranged on vertical another side of the lift arm to turn the bucket with respect to the lift arm, and the hole part is provided in a portion of the lift arm within a region sandwiched between the lift cylinder and the bucket cylinder.

Moreover, according to the piping structure of the front work machine of the present invention, the turnably-supporting part is provided with an opening part that leads the hydraulic piping extended from the main machine side to the hole part.

Furthermore, according to the piping structure of the front work machine of the present invention, a clamp part that fixes the hydraulic piping derived from the opening part in the vicinity of a turning supporting point of the front work machine with respect to the turnably-supporting part is provided.

Moreover, according to the piping structure of the front work machine of the present invention, the hole part is provided with a joining part that joins the hydraulic piping extended from the main machine side with hydraulic piping arranged on the front work machine side.

Furthermore, according to the piping structure of the front work machine of the present invention, in the front work machine mounted on the main machine through the turnably-supporting parts arranged on both right and left sides of the bonnet provided in the front portion of the main machine, a joining position in the joining part is provided laterally outside of the front work machine.

Effect of the Invention

According to the piping structure of the front work machine of the present invention, because the hydraulic piping extended from the main machine side does not need to be arranged between the bonnet and the arm part of the front work machine, space for the piping does not need to be provided between the bonnet and the arm part of the front work machine. Moreover, the hydraulic piping and the bonnet do not interfere with each other when the front work machine moves up and down.

Thereby, since at least enough space not to disturb the vertical turning of the front work machine only need to be assured between the bonnet and the arm part of the front work machine, an increase in total width of the front work machine can be prevented, and thus, an increase in total width of a work vehicle including the main machine can be prevented.

Moreover, according to the piping structure of the front work machine of the present invention, because in providing the hole part, the lift arm does not need to be reinforced, increases in volume and weight of the lift arm, and thus, increases in volume and weight of the whole front work machine can be prevented. That is, for making up for a decrease in strength of the lift arm caused by the provision of the hole part, the thickness of the lift arm needs to be increased or the like, which causes the increases in volume and weight of the lift arm. However, by providing the hole part in the portion where the strength of the lift arm is easily assured, the decrease in strength of the lift arm caused by the provision of the hole part does not need to be made up for, which prevents the increases in volume and weight of the lift arm.

Moreover, according to the piping structure of the front work machine of the present invention, the hydraulic piping from the main machine side can be easily extended using an existing constitution without affecting the total width of the front work machine.

Moreover, by providing the opening part in the vicinity of the turning supporting point of the front work machine, a variation amount of necessary length of the hydraulic piping accompanying the turning of the front work machine can be made smaller, and a burden on the hydraulic piping can be reduced. This can shorten the hydraulic piping, and also improve the durability.

Furthermore, according to the piping structure of the front work machine of the present invention, because the hydraulic piping derived from the opening part and led to the hole part can be fixed in the vicinity of the turning supporting point of the front work machine, the movement of the hydraulic piping caused by the variation of the necessary length of the hydraulic piping accompanying the turning of the front work machine can be restricted, and the sliding of the hydraulic piping with respect to the turnably-supporting part can be prevented. This can reduce a burden on the hydraulic piping accompanying the turning of the front work machine, and improve the durability of the hydraulic piping.

Moreover, according to the piping structure of the front work machine of the present invention, because in arranging the hydraulic piping extended from the main machine side to the front side of the front work machine, the piping can be divided in the middle, so that the size of the hole part can be made small. Thereby, the provision of the hole part does not impair the strength of the front work machine, so that the strength can be maintained, and increases in volume and weight of the front work machine can be prevented.

Furthermore, according to the piping structure of the front work machine of the present invention, in joining the piping in the joining part, favorable workability can be attained, and an increase in total width of the front work machine, and thus, an increase in total width of the work vehicle including the main machine can be prevented.

DETAILED DESCRIPTION OF THE INVENTION

Next, embodiments of the present invention are described.

In the following description, as a work vehicle according to the present invention, a back hoe loader 1 having a loader as a front work machine is described as one example.

Figure 1:
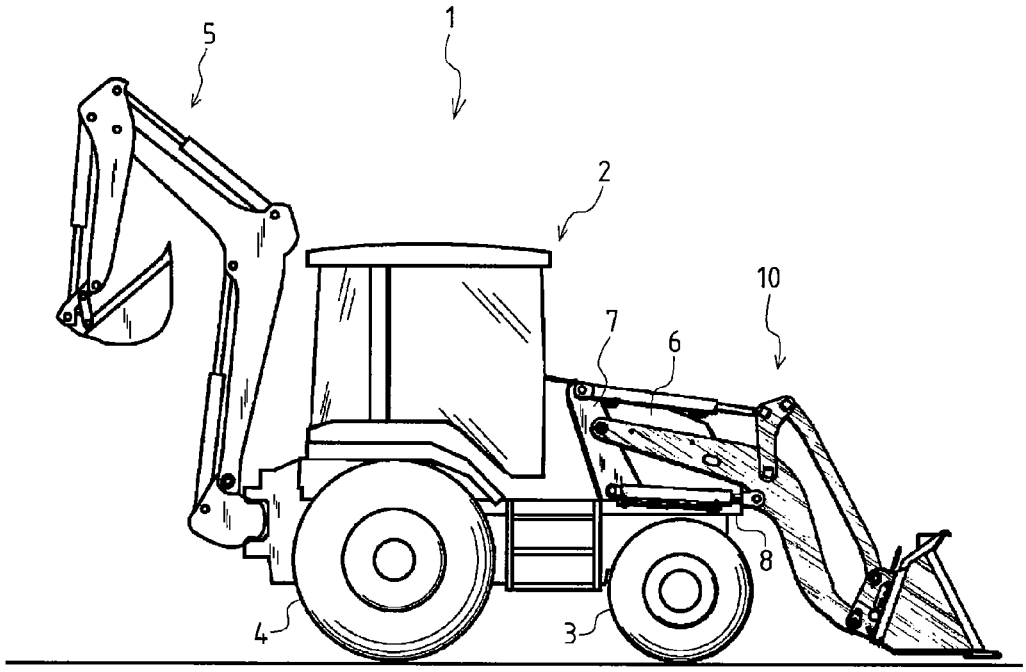
FIG. 1 is an overall side view showing a back hoe loader.

In the back hoe loader 1 as the work vehicle, a running vehicle having front wheels 3, and rear wheels 4 is a main machine 2 as shown in FIG. 1. An excavation device 5 is mounted on the rear side of the main machine 2, and a loader (loading device) 10 as the front work machine is mounted on the front side of the main machine 2.

Moreover, a bonnet 6 is provided in a front portion of a body frame 8 of the main machine 2, and above the front wheels 3. Brackets 7 as turnably-supporting parts are arranged on both right and left sides of the bonnet 6. The brackets 7 are fixed to the body frame 8. That is, the loader 10 as the front work machine is mounted on the main machine 2 through the brackets 7 as the turnably-supporting parts, and is used as a front loader in the front portion of the back hoe loader 1.

Figure 2:
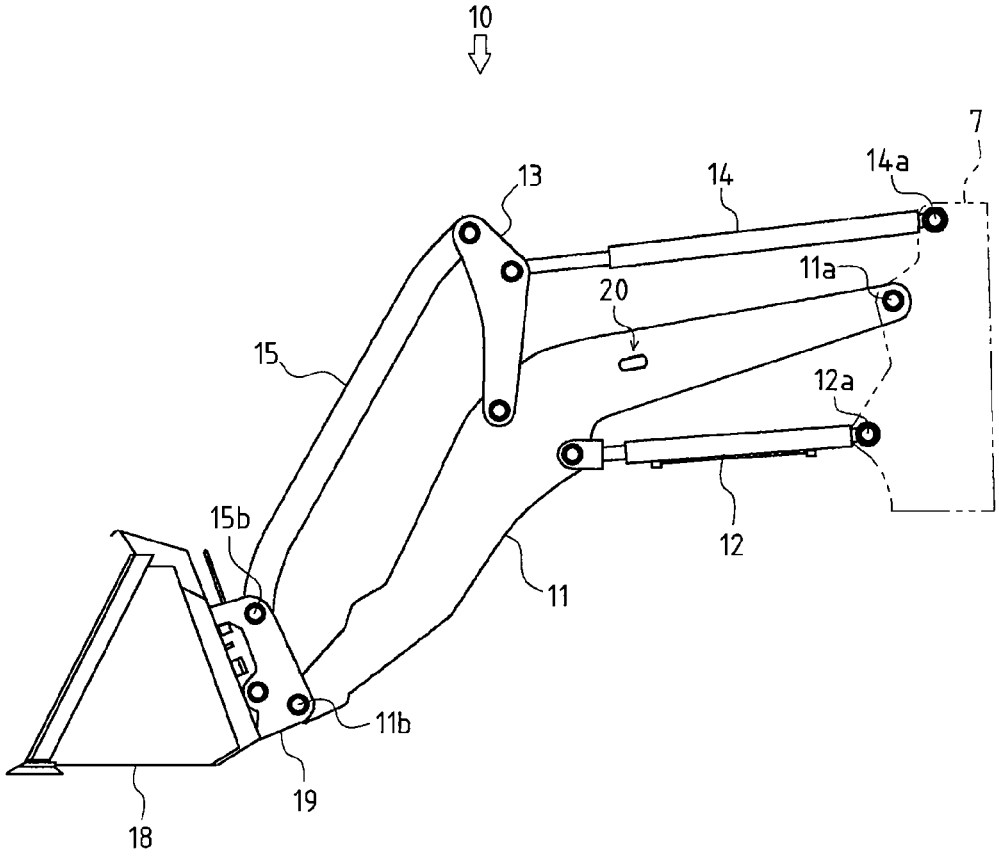
FIG. 2 is a side view showing a loader as a front work machine.
Figure 3:
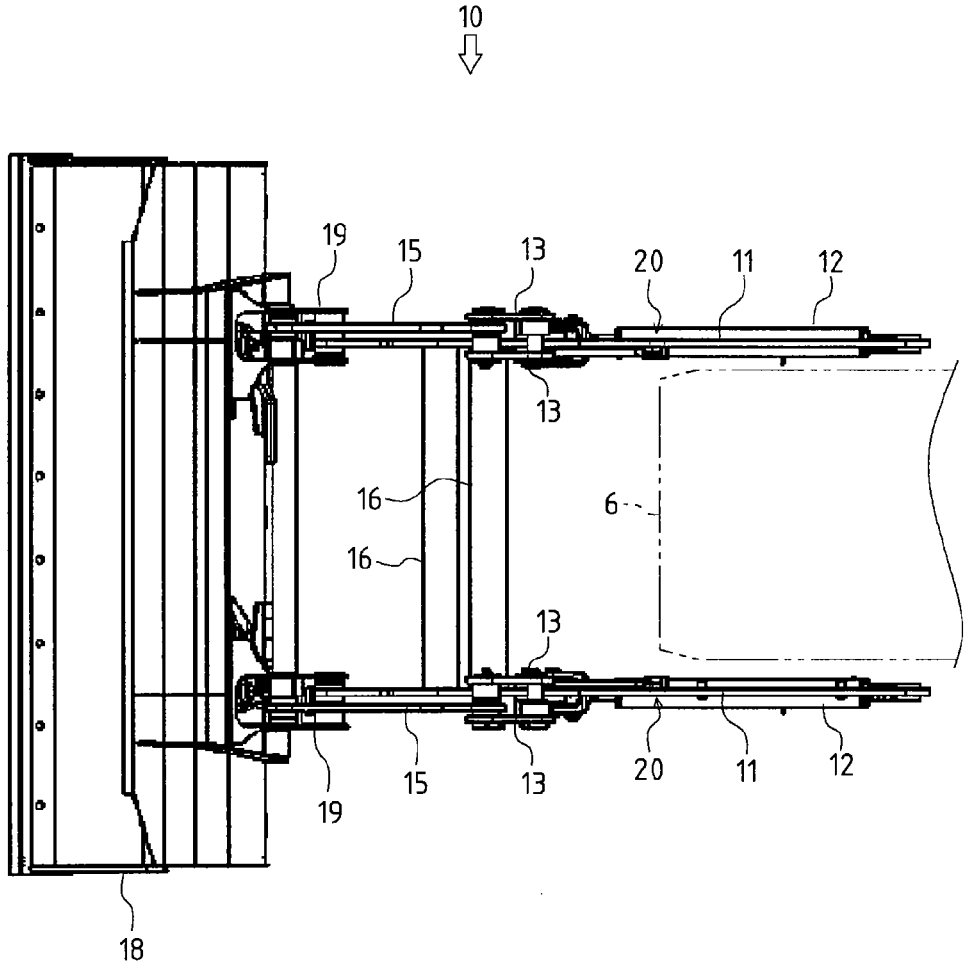
FIG. 3 is a plane view showing the same.
Figure 4:
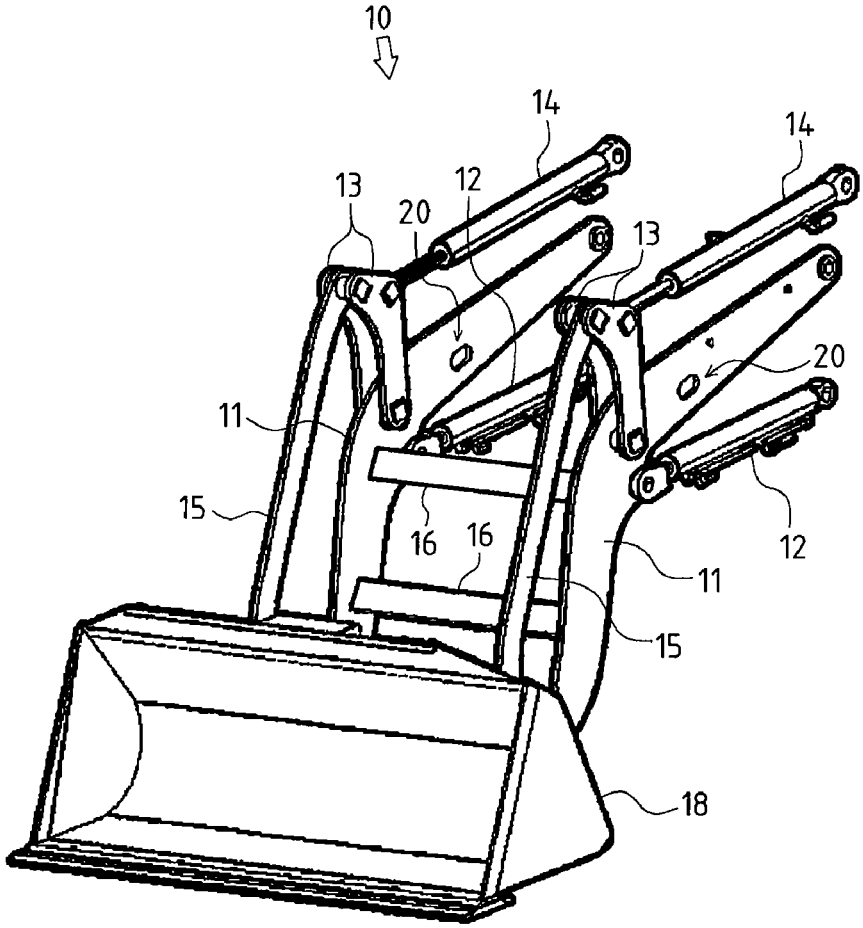
FIG. 4 is a perspective view showing the same.
Figure 5:
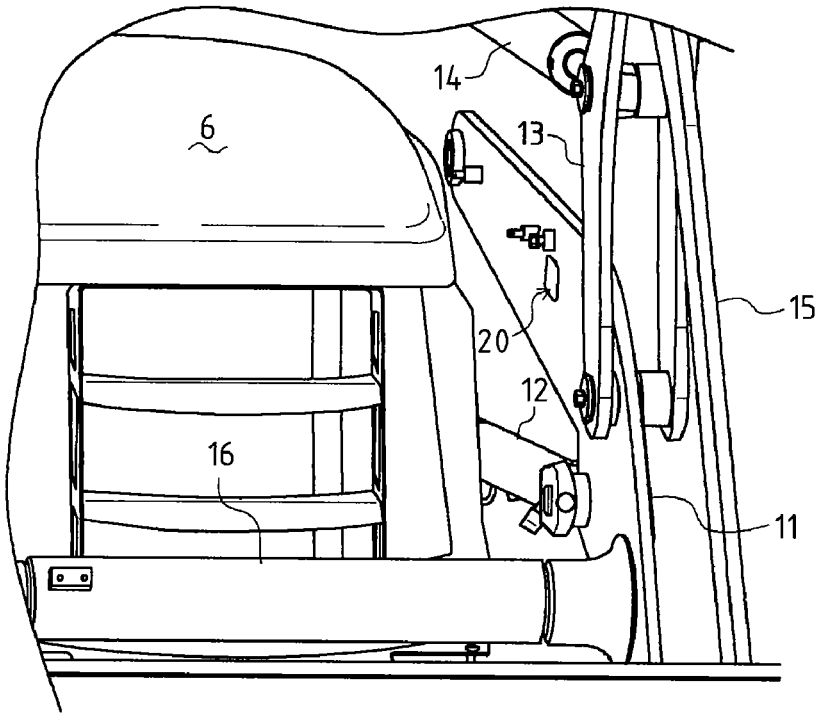
FIG. 5 is a perspective view showing a positional relation between a bonnet and the loader.
Figure 6:
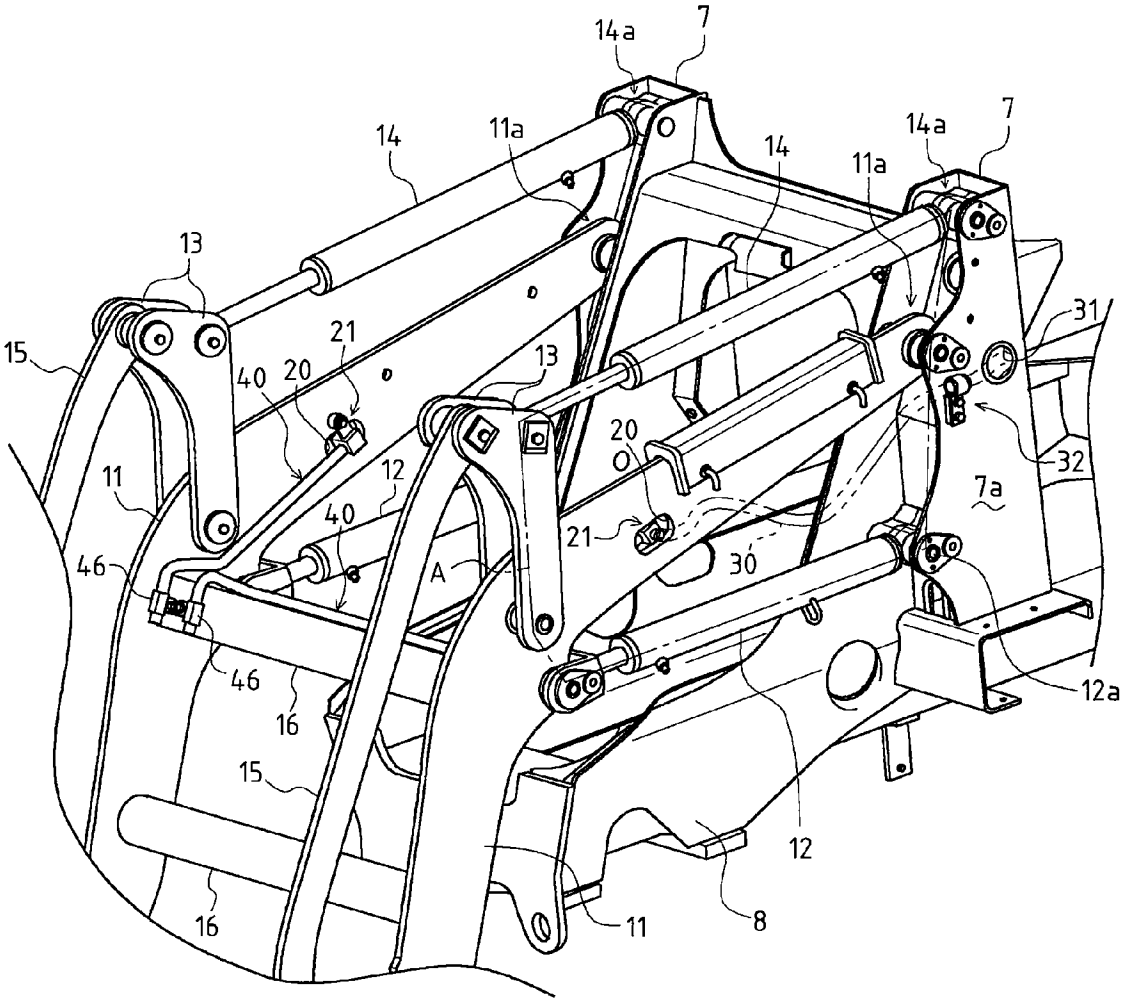
FIG. 6 is a perspective view showing a piping structure of the front work machine according to the present invention.

Further, referring to FIGS. 2 to 4, a constitution of the loader 10 as the front work machine is described. In a plane view shown in FIG. 3, a bucket cylinder 14, which will be described later, is omitted.

The loader 10 is mounted on the front portion of the back hoe loader 1 through the brackets 7 as described before, and is made of a pair of right and left lift arms 11, lift cylinders 12, intermediate links 13, bucket cylinders 14, bucket links 15, and the like. The loader 10 has a bucket 18 as a work part in a front end portion thereof.

The bucket 18 is supported by the tip end portions (front end portions) of the lift arms 11 and the bucket links 15 through attachments 19. More specifically, each of the tip end portions of the lift arms 11 and the bucket links 15 is turnably connected to each of the attachments 19 by a pin or the like, and the bucket 18 is attached to the attachment 19.

Each of the lift arms 11 is a plate-like member that is formed such that an anteroposteriorly central portion is bent upward from a straight line connecting both ends thereof into a chevron shape in side view, a rear end of which is movably supported by each of the brackets 7 provided on the main machine 2 side. Rear end portions of each of the lift cylinders 12 and each of the bucket cylinders 14 are also movably supported by the bracket 7, respectively. Here, as shown in FIG. 2, the movably-supporting part 11*a* of the lift arms 11 is located ahead of, and below a movably-supporting part 14*a* of the bucket cylinder 14, and a movably-supporting part 12*a* of the lift cylinder 12 is located ahead of, and below the movably-supporting part 11*a* of the lift arm 11. That is, the movably-supporting part 11*a* of the lift arm 11 corresponds to a turning supporting point of the loader 10 as the front work machine.

Moreover, a front end portion of the lift cylinder 12 is movably supported by a lower portion of the bent portion, which is the substantially anteroposteriorly central portion of the lift arm 11, and the lift arm 11 is moved up and down with respect to the bracket 7 by the lift cylinder 12.

Moreover, a front end portion of the bucket cylinder 14 is movably supported by the intermediate link 13, which is movably supported by an upper portion of the bent portion of the lift arm 11, and the bucket 18 is turned with respect to the lift arm 11 by the bucket cylinder 14. That is, a lower end portion of the substantially triangle intermediate link 13 in side view is movably supported by the lift arm 11, a rear end portion of the bucket link 15 is movably supported by an upper front portion of the intermediate link 13, and a front end portion of a piston rod of the bucket cylinder 14 is movably supported by an upper rear portion of the intermediate link 13. Here, the intermediate links 13 are made of two substantially triangle plates, and in each of the plates, the bent portion of the lift arm 11, the front end portion of the bucket cylinder 14, and the rear end portion of the bucket link 15 are located and movably supported, respectively.

Although, in the present embodiment, the lift cylinder 12 is arranged below the lift arm 11, and the bucket cylinder 14 is arranged above the lift arm 11, the arrangement may be reverse vertically. More specifically, in the case where these are arranged in a vertically reverse manner, the lift cylinder 12 is movably supported by the upper portion of the bent portion of the lift arm 11, the intermediate link 13 is movably supported by the lower portion of the bent portion of the lift arm 11, and the front end portion of the bucket cylinder 14 and the rear end portion of the bucket link 15 are movably supported by the intermediate link 13, respectively.

Moreover, reinforcement members 16 are provided in the front portions between the lift arms 11 in a lateral direction to increase supporting stiffness of the bucket 18. The reinforcement members 16 are provided in parallel in the anteroposterior direction (vertically) in two positions, and these reinforcement members 16 connect the right and left lift arms 11.

Moreover, the bucket 18 supported through the attachments 19 as described before is constituted detachably with respect to the attachments 19 in a rear surface thereof. Each of the attachments 19 is pivotally supported in a movably-supporting part 11*b* so as to be capable of swing with respect to the lift arm 11, and in an upper portion of the attachment 19, a front end portion of the bucket link 15 is pivotally and turnably supported in a movably-supporting part 15*b*. This allows the bucket link 15 to be moved with respect to the lift arm 11, by which the bucket 18 is swung together with the attachment 19.

In such a constitution, the loader 10 is supported by the brackets 7 on both right and left sides of the bonnet 6, and has right and left arm parts in parallel in plane view, which are made of the lift arms 11, lift cylinders 12, bucket cylinders 14, intermediate links 13, bucket links 15 and the like. Additionally, the loader 10 is provided with the bucket 18 as the work part in the front end portions of the right and left arm parts, and is constituted so as to be vertically turnable with respect to the main machine 2 side with the bonnet 6 arranged in a rear portion between the right and left arm parts.

In the loader 10 constituted as described above, the bucket 18 as the work part is constituted detachably through the attachments 19 as described before, and in some cases, as this work part, in addition to the bucket 18 in the present embodiment, for example, one necessary for hydraulics, such as a bucket constituted so as to be openable and closable by a hydraulic cylinder, and an auger driven by a hydraulic motor or the like, may be attached. Moreover, some have a constitution in which the bucket link 15 and the bucket cylinder 14 are exchanged to be mounted. In these cases, the hydraulic piping is extended from the main machine 2 side along side surface of the lift arm 11, and hydraulic oil is supplied through this hydraulic piping, which enables the work machine necessary for hydraulics as described above to be driven.

The loader 10 as the front work machine has the following piping structure when the hydraulic piping is extended from the main machine 2 side.

That is, the loader 10 as the front work machine according to the present invention is provided with hole parts 20 through which the hydraulic piping penetrates the structural members in the lateral direction. In the present embodiment, the hole parts 20 through which the hydraulic piping passes are provided in the lift arms 11, which are the constructional members of the loader 10. More specifically, the hole parts 20 through which the hydraulic piping can pass in the lateral direction are provided in the lift arms 11, which are plate members located on both right and left sides of the bonnet 6, and through the hole parts 20, the hydraulic piping extended from the main machine 2 side is led to the front portion of the loader 10. Additionally, although the lift arms 11 were conventionally made of pipes and the like, in the present embodiment, the use of the plate members reduces a lateral width, improves a forward visual field, and enables the hole parts 20, which are through-holes in the lateral direction, to be formed easily.

At this time, in the hydraulic piping extended from the main machine 2 side, on the rear side (the main machine 2 side) from the hole parts 20, the hydraulic piping is arranged laterally outside of the lift arms 11, and by passing through the hole parts 20, the hydraulic piping is arranged toward the front side between (inside of) the right and left lift arms 11.

That is, the hole parts 20 are provided in the lift arms 11 on the front side of the bonnet 6, or provided at least in positions of a front end portion of the bonnet 6 in the anteroposterior direction, which allows the hydraulic piping extended from the main machine 2 side to be arranged from the outside of the right and left lift arms 11 to the inside of the both lift arms 11 through the hole parts 20. Thereby, the hydraulic piping is arranged without being arranged between the bonnet 6 and the arm parts of the front work machine including the lift arms 11.

In this manner, by providing the hole parts 20 in the lift arms 11, which are the constructional members of the loader 10 as the front work machine, it becomes unnecessary to arrange the hydraulic piping extended from the main machine 2 side between the bonnet 6 and the arm parts of the front work machine, which makes it unnecessary to provide space for piping between the bonnet 6 and the arm parts of the front work machine, and also, prevents the hydraulic piping and the bonnet 6 from interfering with each other when the loader 10 moves up and down. Thereby, because at least enough space not to disturb the vertical turning of the loader 10 only needs to be assured between the bonnet 6 and the arm parts of the front work machine, an increase in total width of the loader 10 can be prevented, and thus, an increase in total width of the back hoe loader 1 as the work vehicle including the main machine 2 can be prevented.

Even in the case where the hole parts 20 are provided in positions of the lift arms 11 in the front end portion of the bonnet 6 in the anteroposterior direction, if the bonnet 6 forms a curved surface tapered toward the front end, the space for piping is assured without providing special space between the bonnet 6 and the arm parts of the front work machine, thereby bringing about the similar effect. That is, even if the hole parts 20 are arranged so that a vertically turning locus thereof overlaps the front portion of the bonnet 6 in side view, the front side portion of the bonnet 6 is formed into the curved surface with the lateral width decreased in plane view, so that it does not interfere when the lift arms 11 moves up and down.

Hereinafter, referring to FIGS. 5 to 11, the piping structure according to the present invention is described specifically, following the present embodiment.

As described before, the loader 10 as the front work machine has the bucket 18 provided in the front end portion, the lift arms 11 movably supported by the brackets 7, the lift cylinders 12, which are movably supported by the brackets 7 similarly, and are arranged below the lift arms 11 to move up and down the lift arms 11 with respect to the brackets 7, and the bucket cylinders 14, which are movably supported by the brackets 7 similarly, and are arranged above the lift arms 11 to turn the bucket 18 with respect to the lift arms 11.

In the loader 10 having the above-described structure, it is preferable that each of the hole parts 20 is provided in a portion of the lift arm 11 within a region sandwiched by the lift cylinder 12 and the bucket cylinder 14. More specifically, as indicated by long and short dash line in FIG. 6, the hole part 20 is provided in the portion of the lift arm 11 in a region A sandwiched by the bucket cylinder 14, which is arranged above the lift arm 11, and the lift cylinder 12, which is arranged below the lift arm 11.

The portion of the lift arm 11 within the region A is a portion on the main machine 2 side from the intermediate link 13 provided above the chevron-shaped bent portion in side view, and where strength thereof is easily assured. That is, the portion of the lift arm 11 within the region A is supported by the bucket cylinder 14 through the intermediate link 13 on the upper side, and is supported by the lift cylinder 12 on the lower side. Therefore, as compared with a front portion of the portion of the lift arm 11 within the region A, the load from the bucket 18 is smaller, and the strength is easily assured.

In this manner, by providing the hole part 20 in the portion where the strength is easily assured in the lift arm 11, the reinforcement of the lift arm 11 becomes unnecessary, which can prevent increases in volume and weight of the lift arm 11, and thus, increases in volume and weight of the whole loader 10 in providing of the hole part 20.

More specifically, for making up for decrease in strength of the lift arm 11 caused by the provision of the hole part 20, the lift arm 11 needs to be increased in thickness, thereby causing the increases in volume and weight of the lift arm 11. In contrast, by providing the hole part 20 in the portion where the strength of the lift arm 11 is easily assured, the decrease in strength of the lift arm 11 caused by the provision of the hole part 20 does not need be made up for, which can prevent the increases in volume and weight in the lift arm 11.

Moreover, in the piping structure according to the present invention, in extending the hydraulic piping from the main machine 2 side, opening parts are provided in the brackets 7 as the turnably-supporting parts.

Figure 7:
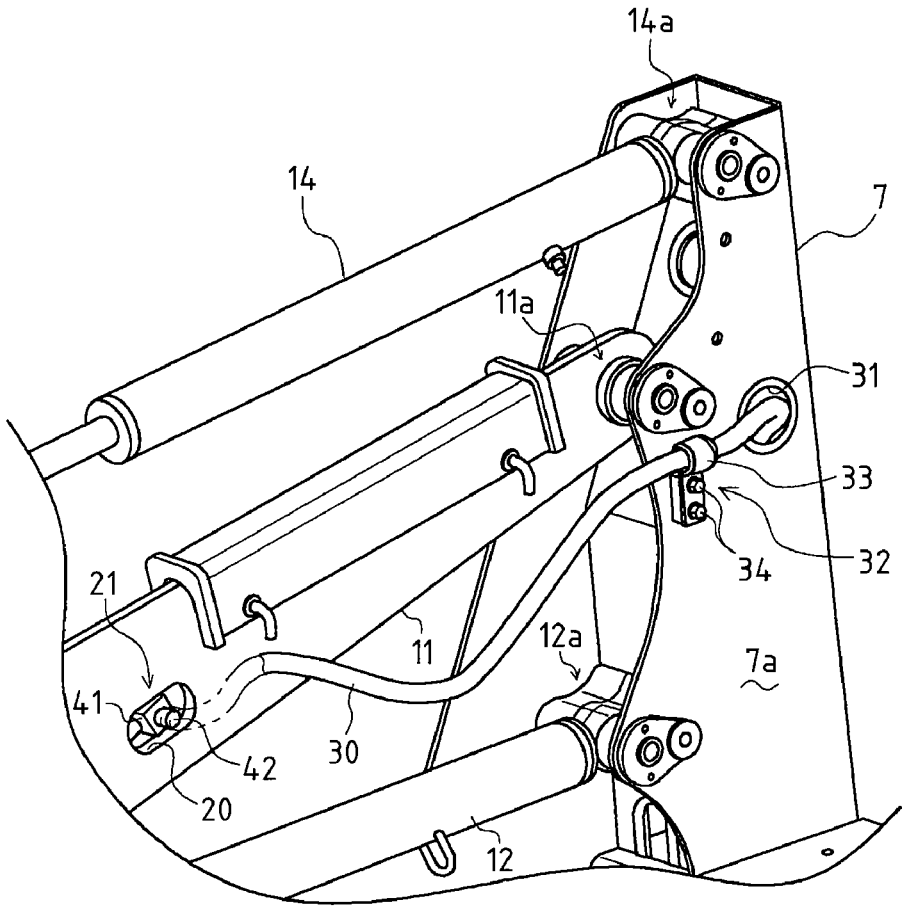
FIG. 7 is a partially enlarged view of the same.

That is, as shown in FIG. 7, the brackets 7 are provided with opening parts 31 leading hydraulic piping 30 extended from the main machine 2 side to the hole parts 20.

The opening parts 31 are provided in the right and left brackets 7 constituted into a substantially "U" shape in plane view so that the hydraulic piping 30 extended from the main machine 2 side is extended from the lateral outside. That is, the hydraulic piping 30 from the main machine 2 side is extended laterally outside through the opening parts 31, and is arranged laterally outside of the lift arms 11 to be led to the hole parts 20.

Moreover, each of the opening parts 31 is preferably provided in the vicinity of the movably-supporting part 11*a* of the lift arm 11, which is the turning supporting point with respect to the bracket 7.

That is, by providing, in the vicinity of the movably-supporting part 11*a* of the lift arm 11, the opening part 31 through which the hydraulic piping 30 to be arranged from the main machine 2 side to the loader 10 side is extended, a variation amount of the necessary length of the hydraulic piping 30 accompanying the vertical turning of the loader 10 can be made smaller. In other words, the amount of extension and contraction, and bending of the hydraulic piping 30 caused by the vertical turning of the loader 10 can be made smaller, and looseness for giving allowance can be made smaller.

In this manner, by providing the opening part 31 in the bracket 7 as the turnably-supporting part, the hydraulic piping 30 from the main machine 2 side can be easily extended using the existing constitution without affecting the total width of the loader 10 as the front work machine.

Moreover, by providing the opening part 31 in the vicinity of the movably-supporting part 11*a*, which is the turning supporting point of the loader 10, the variation amount of the necessary length of the hydraulic piping 30 accompanying the turning of the loader 10 can be made smaller, and thus, the burden on the hydraulic piping 30 can be reduced. This can shorten the hydraulic piping 30 and can improve the durability.

Additionally, in extending the hydraulic piping 30 from the main machine 2 side through the opening parts 31 provided in the brackets 7 as described above, there are provided clamp parts 32 that fix the hydraulic piping 30 derived from the opening parts 31, in the vicinity of the movably-supporting parts 11*a*, which are the turning supporting points of the loader 10 with respect to the brackets 7.

That is, the clamp parts 32 fix the hydraulic piping 30 extended from the opening parts 31 of the brackets 7 laterally outside, in the vicinity of the movably-supporting parts 11*a* of the lift arms 11 in outer side surfaces 7*a* of the brackets 7.

Each of the clamp parts 32, as shown in FIG. 7, is constituted such that a clamp body 33 of a metal plate folded and formed to match a pipe diameter of the hydraulic piping 30 is firmly fixed to the outer side surface 7*a* of the bracket 7 by a fastener 34 such as bolts or by welding.

The constitution of the clamp part 32 is not limited to that of the present embodiment, as long as it has the function of fixing the hydraulic piping 30 derived from the opening part 31 to the outer side surface 7*a* of the bracket 7. The clamp parts 32, for example, may be constituted integrally with the bracket 7, or may be constituted adjustably in accordance with the pipe diameter of the hydraulic piping 30.

In this manner, since by providing the clamp part 32 fixing the hydraulic piping 30, the hydraulic piping 30 derived from the opening part 31 and led to the hole part 20 can be fixed in the vicinity of the movably-supporting part 11*a*, which is the turning supporting point of the loader 10 as the front work machine, the movement of the hydraulic piping 30 caused by the variation in the necessary length of the hydraulic piping 30 accompanying the turning of the loader 10 can be restricted, and the sliding of the hydraulic piping 30 with respect to the bracket 7 can be prevented. This can reduce the burden on the hydraulic piping 30 accompanying the turning of the loader 10, and can improve the durability of the hydraulic piping 30.

Moreover, in the piping structure according to the present invention, a joining part 21 that joins the hydraulic piping 30 extended from the main machine 2 side with the hydraulic piping arranged on the loader 10 side (hereinafter, referred to as "PTO piping 40") is provided in the hole part 20 provided in the lift arm 11. That is, in this joining part 21, a tip end portion of the hydraulic piping 30 extended from the main machine 2 side and a rear end portion of the PTO piping 40 arranged on the loader 10 side are joined.

The joining constitution between the hydraulic piping 30 and the PTO piping 40 in the joining part 21 is more specifically described in reference to FIGS. 8 to 11.

As shown in FIGS. 8 to 11, a substantially rectangular parallelepiped base portion 41 is formed in an end portion of the PTO piping 40. In one side surface of the base portion 41, a joining body 42 to which the hydraulic piping 30 from the main machine 2 side is connected is projected. On the other hand, in an end portion of the hydraulic piping 30 from the main machine 2 side, a joining member 36 constituted connectably to the joining body 42 is provided. By screwing these joining body 42 and the joining member 36, the joining body 42 and the joining member 36 are connected, so that the hydraulic piping 30 from the main machine 2 side and the PTO piping 40 arranged on the loader 10 side are joined.

That is, a screw portion is provided in an outer periphery of the joining body 42, while the joining member 36 is constituted so as to be threaded inside and be turnable with respect to the pipe of the hydraulic piping 30. By screwing the joining body 42 into the joining member 36, the hydraulic piping 30 and the PTO piping 40 are connected in the joining part 21.

In this case, as the connecting constitution of the hydraulic piping 30 and the PTO piping 40, in addition to the constitution of screwing the joining member 36 and the joining body 42 as in the present embodiment, for example, a fitting type constitution and the like can be considered, in which the joining member 36 on the hydraulic piping 30 side is fitted outside of the joining body 42 on the PTO piping 40 side by a single operation.

Moreover, in the joining part 21, the PTO piping 40 is fixed to the inside of the lift arm 11 by a fastener 43 such as a bolt. That is, on the PTO piping 40 side, a stay 44 is formed in one side surface (upper side surface in the present embodiment) of the base portion 41, and on the lift arm 11 side, a boss 45 for fixing the PTO piping 40 is formed in the vicinity of the hole part 20 in the inner surface. The inside of the boss 45 is threaded, and the fastener 43 is screwed into the boss 45 through the stay 44 of the PTO piping side, by which the PTO piping 40 is fixed to the inner surface of the lift arm 11.

The fixing method of the PTO piping 40 to the lift arm 11 is not limited to that of the present embodiment, but the PTO piping 40 can be fixed to the lift arm 11, for example, by welding or the like.

In this manner, by providing the joining part 21 between the hydraulic piping 30 and the PTO piping 40 in the hole part 20, in arranging the hydraulic piping 30 extended from the main machine 2 side to front side of the loader 10, the piping can be divided in the middle, which can reduce the hole part 20 in size.

That is, in the hydraulic piping, a minimum bend radius differs depending on the pipe diameter, and as the pipe diameter becomes larger, the minimum bend radius becomes larger. Therefore, if one hydraulic pipe is used and arranged from the main machine 2 side to the front side of the loader 10, as the pipe diameter of the hydraulic piping 30 from the main machine 2 side becomes larger, the hole part 20 needs to become larger. Thus, as the hole part 20 is formed to be larger, the strength of the lift arm 11 will be impaired, and thus, the strength of the whole loader 10 will be impaired.

Consequently, as described above, since the provision of the joining part 21 in the hole part 20 eliminates the dependency of the size of the hole part 20 on the pipe diameter (minimum bend radius) of the piping joined in the joining part 21, the hole part 20 can be constituted so as to be constantly small regardless of the type of the joined piping. Thereby, the provision of the hole part 20 does not impair the strength of the lift arm 11, so that the strength of the loader 10 can be maintained, and increases in volume and weight of the loader 10 accompanying the reinforcement of the lift arm 11 can be prevented.

Furthermore, the joining position in the joining part 21 is provided laterally outside of the loader 10. More specifically, the joining body 42 on the PTO piping 40 side, which makes up the joining part 21, is projected outside of the lift arm 11 from the inside of the lift arm 11 through the hole part 20.

Figure 8:
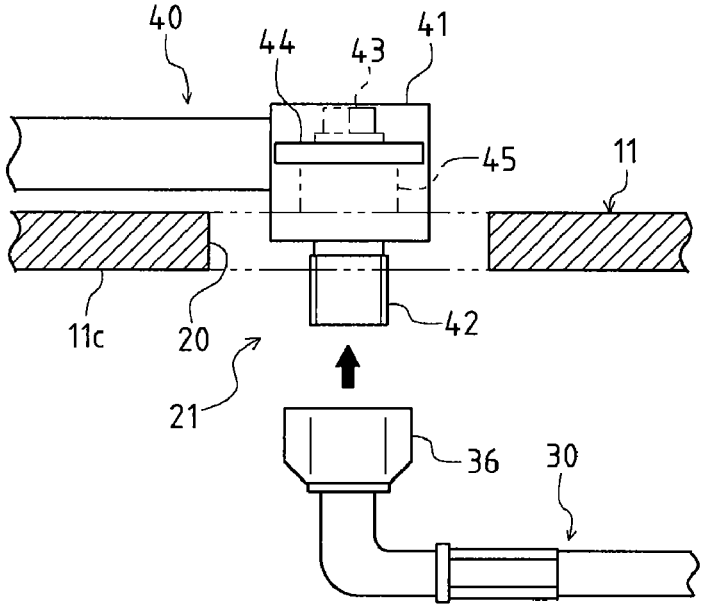
FIG. 8 is a plane view showing a structure of a joining part.
Figure 9:
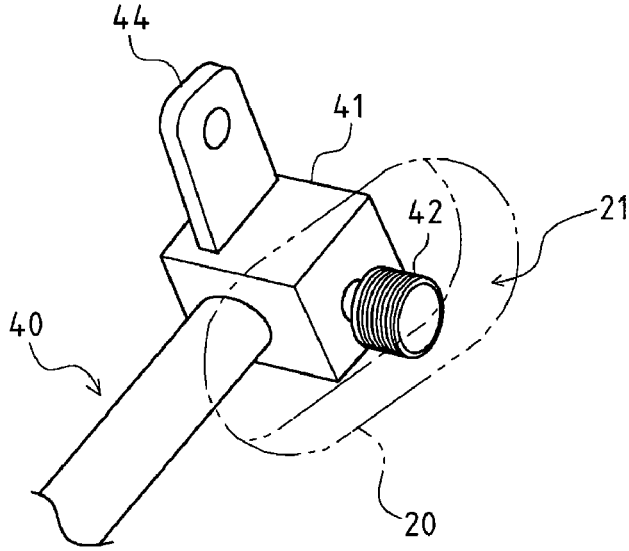
FIG. 9 is a perspective view showing the same.
Figure 10:
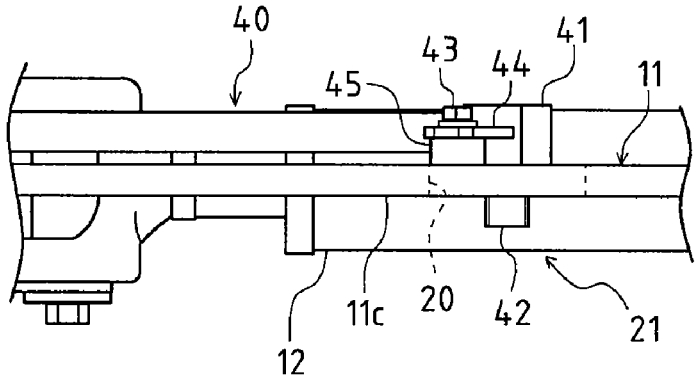
FIG. 10 is a plane view showing the joining part.
Figure 11:
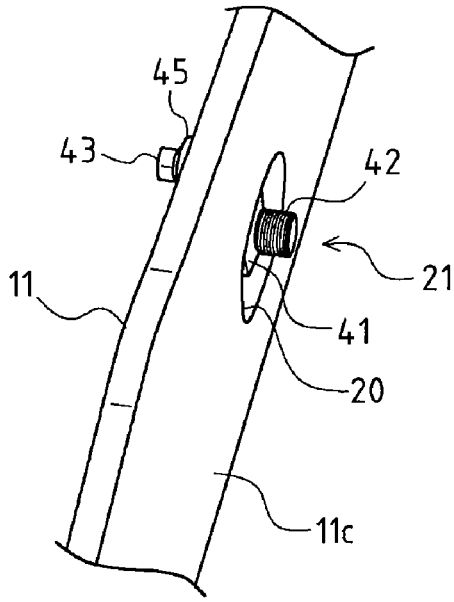
FIG. 11 is a perspective view showing the same.

That is, as shown in FIGS. 8, 10 and 11, in a state where the PTO piping 40 is fixed to the lift arm 11 side as described before, a tip end portion of the joining body 42 is projected laterally outside of an outer surface 11*c* of the lift arm 11. Thereby, the joining position between the joining member 36 and the joining body 42 in the joining part 21 is laterally outside of the arm part of the loader 10, so that the joining position between the hydraulic piping 30 and the PTO piping 40 is provided laterally outside of the loader 10.

In this manner, by providing the joining position in the joining part 21 laterally outside of the arm part of the loader 10, favorable workability can be attained when piping is joined in the joining part 21, and an increase in total width of the loader 10 and thus, an increase in total width of the whole back hoe loader 1 including the main machine 2 can be prevented.

That is, if the joining position in the joining part 21 is provided laterally inside of the loader 10, thereby located inside of the hole part 20, the workability in joining of the joining member 36 of the hydraulic piping 30 and the joining body 42 of the PTO piping 40 is reduced, but as described before, by providing the joining position of the joining part 21 laterally outside of the loader 10, the joining work can be performed outside of the loader 10, more specifically outside of the outer surface 11*c* of the lift arm 11, which can bring about favorable workability.

Moreover, if the joining position in the joining part 21 is provided inside of the loader 10, the joining work is performed inside of the loader 10 and depending on the position of the hole part 20, the joining part 21 is located between the bonnet 6 and the arm part of the loader 10, which forces the work in a narrow, limited space, thereby reducing the workability. However, since the joining work can be performed outside of the loader 10 as described before, favorable workability can be attained.

Furthermore, if the joining work is performed inside of the loader 10, in order to prevent the reduction in workability in the narrow space, the need to assure work space between the bonnet 6 and the arm part of the loader 10 arises, which causes an increase in total width of the loader 10. However, the provision of the joining position of the joining part 21 laterally outside of the arm part of the loader 10, as described before, can prevent the increase in total width of the loader 10.

With the above-described constitution, the hydraulic piping 30 extended from the main machine 2 side is joined with the PTO piping 40 in the joining parts 21 made up in the hole parts 20 provided in the arm parts on both right and left sides of the loader 10. The PTO piping 40 extended from the joining parts 21 is, for example, arranged along the constructional members of the loader 10 as shown FIG. 6 and the like, and are fixed by clamp parts 46 and the like, which are provided in the reinforcement member 16 as necessary.

That is, the PTO piping 40 is extended by connecting another piping to a tip end portion thereof or the like, and is delivered to the bucket openable and closable by the hydraulic cylinders, the hydraulically-driven auger, or the like, which are provided in the loader 10 as the work part.

The hydraulic oil supplied through the PTO piping 40 is not limited to the use for the work part of the loader 10 as the front work machine, but for example, it can also be used as hydraulic oil for a work machine used separately from the loader 10.

While in the foregoing, the loader 10 having the two arm parts through the brackets 7 arranged on both right and left sides of the bonnet 6 is described as an example of the front work machine, the piping structure according to the present invention can be applied to a front work machine having the turnably-supporting part such as the bracket on only one of the right and left sides of the bonnet 6.

INDUSTRIAL APPLICABILITY

The piping structure of the front work machine according to the present invention can prevent an increase in total width of the front work machine caused by the hydraulic piping extended from the main machine side, and enables the piping following the structure of the front work machine turning vertically, thereby reducing a burden on the hydraulic piping accompanying the turning of the front work machine and improving the durability. Accordingly, it is industrially useful.

The invention claimed is:

1. A piping structure of a front work machine, wherein said piping structure of said front work machine is mounted on a main machine through turnably-supporting parts on both right and left sides of a bonnet provided in a front portion of the main machine, or a turnably-supporting part on one side thereof, said piping structuring comprising:

a bucket provided in a front end portion thereof, a lift arm movably supported by said turnably-supporting part, a lift cylinder movably supported by said turnably-supporting part, and arranged on one vertical side of said lift arm to move up and down the lift arm with respect to said turnably-supporting part, a bucket cylinder movably supported by said turnably-supporting part, and arranged on another vertical side of said lift arm to turn said bucket with respect to said lift arm, and a hole part through which hydraulic piping passes from one side of said lift arm to another side of said lift arm, where said hole part is provided in a portion of said lift arm within a region above said lift cylinder and below said bucket cylinder so as to be disposed between said lift cylinder and said bucket cylinder.

2. The piping structure of the front work machine according to claim 1, wherein said turnably-supporting part is provided with an opening part that leads the hydraulic piping extended from the main machine side to said hole part.

3. The piping structure of the front work machine according to claim 2, wherein a clamp part that fixes the hydraulic piping derived from said opening part in the vicinity of a turning supporting point of the front work machine with respect to said turnably-supporting part is provided.

4. The piping structure of the front work machine according to claim 1, wherein said hole part is provided with a joining part that joins the hydraulic piping extended from the main machine side with hydraulic piping arranged on the front work machine side.

5. The piping structure of the front work machine according to claim 4, wherein a joining position in said joining part is oriented laterally outside of the front work machine.

6. The piping structure of the front work machine according to claim 2, wherein said hole part is provided with a joining part that joins the hydraulic piping extended from the main machine side with hydraulic piping arranged on the front work machine side.

7. The piping structure of the front work machine according to claim 3, wherein said hole part is provided with a joining part that joins the hydraulic piping extended from the main machine side with hydraulic piping arranged on the front work machine side.

* * * * *

UNITED STATES PATENT AND TRADEMARK OFFICE

CERTIFICATE OF CORRECTION

PATENT NO. : 7,735,248 B2
APPLICATION NO. : 11/908703
DATED : June 15, 2010
INVENTOR(S) : Sakada et al.

It is certified that error appears in the above-identified patent and that said Letters Patent is hereby corrected as shown below:

Title Page; item (86);
The § 371(c)(1) date should read "Nov. 2, 2007"

Title Page; item (57); line 2;
In the Abstract section, delete "increase in total with" and insert --increase in total width--

Signed and Sealed this

Twenty-eighth Day of September, 2010

David J. Kappos

David J. Kappos
*Director of the United States Patent and Trademark Office*